US006589301B1

(12) United States Patent
Magnin et al.

(10) Patent No.: US 6,589,301 B1
(45) Date of Patent: Jul. 8, 2003

(54) METHOD FOR PREPARING AN EMULSIFIED FUEL AND IMPLEMENTING DEVICE

(75) Inventors: César Magnin, Montagny (FR); Jean-Bernard Prudhomme, Saint Just Chaleyssin (FR); Philippe Schulz, Saint Foy les Lyon (FR)

(73) Assignee: Elf Antar France, Courbevoie (FR)

( * ) Notice: Subject to any disclaimer, the term of this patent is extended or adjusted under 35 U.S.C. 154(b) by 0 days.

(21) Appl. No.: 09/600,171

(22) PCT Filed: Dec. 8, 1999

(86) PCT No.: PCT/FR99/03055

§ 371 (c)(1),
(2), (4) Date: Mar. 5, 2001

(87) PCT Pub. No.: WO00/34419

PCT Pub. Date: Jun. 15, 2000

(30) Foreign Application Priority Data

Dec. 8, 1998 (FR) ..... 98 12625

(51) Int. Cl.[7] ..... C10L 1/32

(52) U.S. Cl. ..... 44/301; 44/302; 44/639; 366/176.1

(58) Field of Search ..... 44/301, 302, 639; 366/176.1

(56) References Cited

U.S. PATENT DOCUMENTS 2,086,775 A * 7/1937 Lyons et al.
2,151,432 A * 3/1939 Lyons et al.
2,920,948 A * 1/1960 Weeks
3,233,986 A * 2/1966 Morehouse
3,281,438 A * 10/1966 Johnson
3,658,302 A * 4/1972 Kuthion et al.
3,818,876 A * 6/1974 Voogd ..... 123/25 R
4,162,143 A * 7/1979 Yount, III
4,173,455 A * 11/1979 Fodor et al.
4,629,472 A * 12/1986 Haney, III et al.
4,744,796 A * 5/1988 Hazbun et al.
4,770,670 A * 9/1988 Hazbun et al.
4,892,562 A * 1/1990 Bowers
5,000,757 A * 3/1991 Puttock et al. ..... 44/301
5,156,114 A * 10/1992 Gunnerman ..... 123/1 A
5,873,916 A * 2/1999 Cemenska et al. ..... 44/301

FOREIGN PATENT DOCUMENTS

DE 19704874 A1 * 8/1997
WO WO 93/07238 * 4/1993
WO WO 95/27021 * 10/1995
WO WO 95/33023 * 12/1995

* cited by examiner

*Primary Examiner*—Margaret Medley
(74) *Attorney, Agent, or Firm*—Dennison, Schultz & Dougherty

(57) ABSTRACT

A process and apparatus for industrial-scale preparation of an emulsified fuel including a water phase in a continuous organic phase which contains less than 20% by volume of water, and at least one additive necessary for forming the emulsified fuel. The fuel is formed by mixing and homogenizing the organic phase and the additives, forming a volume V, inside an homogenization tank with internal circulation rate Qc, such that $Qc/V \geqq 100\ h^{-1}$, circulating the homogenized fluid in a branch loop emerging from the tank at a rate Qcirc, and through at least one emulsifying system located on said loop, at a rate such that $0\ h < V/Qcirc \leqq 2\ h$, feeding the aqueous phase into the branch loop upstream of the emulsifying system, and maintaining the homogenization in the tank and the circulation of the liquid in the branch loop until the emulsion acquires a desired characteristic of storage stability.

16 Claims, 1 Drawing Sheet

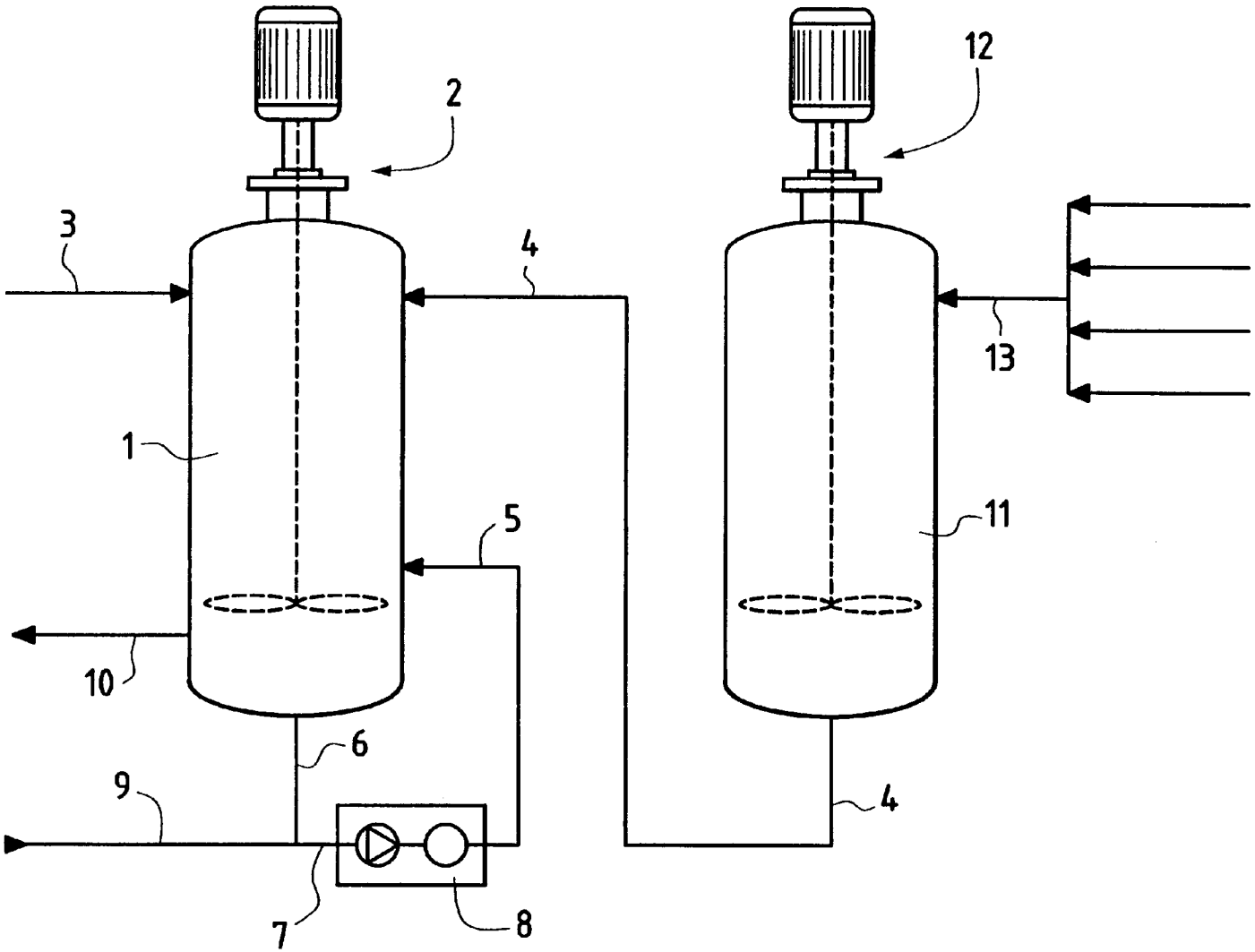
12
13
11
4
4
2
5
8
6
7
1
3
10
9

METHOD FOR PREPARING AN EMULSIFIED FUEL AND IMPLEMENTING DEVICE

BACKGROUND OF THE INVENTION

The present invention relates to a process for the preparation of an emulsified fuel, i.e. an emulsified mixture of water and at least one organic compound, to be distributed in the same way as other liquid fuels, especially petroleum-based motor fuels and domestic fuel oils. In these fuels, the organic phase is a petroleum product, a vegetable or animal oil or any other fuel used particularly in motor vehicles and domestic boilers and more generally for running internal combustion engines or the like and for running power generating equipment. The invention further relates to a device for the industrial implementation of said process in the form of fixed or transportable industrial units.

DESCRIPTION OF RELATED ART

The use of emulsified fuel is well known to those skilled in the art, but is difficult to implement because of the lack of stability of the fuel emulsions used. The storage stability of these emulsions has been defined by the Directorate for Hydrocarbons of the French Ministry of Industry. According to this Administration, a water-in-gas oil emulsion is considered to be stable on storage at ambient temperature if no phase separation is observed after at least four months.

Thus patents DE 19 704 874, DD 216 863 and WO 95/33023 particularly describe processes and devices for obtaining fuel emulsions of the diesel type which are installed in terrestrial vehicles. Such fuels are obtained by mixing the components and emulsifying this mixture on the vehicle itself. The emulsions described are ones in which the continuous phase can be aqueous, it being possible for the latter subsequently to be inverted by dilution in an organic phase, as in patent DE 19 704 874. The emulsion described in patent WO 95/33023 contains less than 20% by volume of water, the aqueous phase constituting the continuous phase.

Likewise, patent application WO 92/11927 relates to the preparation of a concentrated emulsion containing from 40 to 80% by volume of water, which consists in separately preparing a fuel oil/emulsifier mixture and a water/alcohol mixture and introducing these two mixtures at two different points into a circulation loop comprising an emulsifying pump, which also serves to circulate all the ingredients in said loop. The concentrated emulsion formed is collected at another point on the loop.

Patent application WO 95/27021 claims an emulsified aqueous fuel of hydrocarbon in water containing 20 to 80% by volume of water, which constitutes the continuous phase of the emulsion, and 2 to 20% by volume of an alcohol, the remainder being formed of hydrocarbons and a non-ionic emulsifier. In said patent application the hydrocarbon is petrol, kerosene, gas oils, synthetic fuel oils or derivatives of vegetable or animal oils. Said patent application also claims a process for the bulk preparation of this emulsified fuel oil, which is stable for at least three months and consists on the one hand of a mixture of hydrocarbon and emulsifier and on the other hand of a mixture of water and alcohol.

None of these patent applications describes a method for the industrial preparation of stable emulsified fuels in which the organic phase constitutes the continuous phase of the emulsion. Now, for obvious reasons of compatibility of the fuel with the parts located between the tank and the system for introduction into the engine, it is preferred to use a fuel whose continuous phase is identical to that of the fuel for which these parts were dimensioned. In the case of emulsified motor fuels whose continuous phase is aqueous, phenomena involving corrosion of metal surfaces and/or premature wear of elastomeric materials can occur. In addition, the combustion of a water-in-oil emulsion is better than that of an oil-in-water emulsion because the sudden vaporization of the water droplets dispersed in the oil considerably improves the dispersion of the hydrocarbons in the combustion chamber (SAE 89 0449 and SAE 92 0464 to M. Tsukuhara et al., SAE 92 0198 to N. Sawa et al.).

The Applicant proposed such a motor fuel in patent application WO 97/34969.

The present invention relates to the preparation of such emulsified fuels whose continuous phase is an organic compound and which can be stable for a sufficiently long period, for example of more than 4 months, to allow their storage in industrial quantities and their subsequent distribution by means of a pump in the same way as motor fuels or other fuels.

SUMMARY OF THE INVENTION

The present invention therefore relates to a process for the industrial-scale preparation of an emulsified fuel of water in organic compound(s) whose continuous phase is organic and which contains less than 20% by volume of water and at least one additive necessary for forming the emulsion, said process being characterized in that it consists essentially in:

- 1 introducing the additive(s) into a tank equipped with at least one agitator with axial pumping displacement and containing at least the organic compound(s),
- 2 homogenizing the resulting volume V of liquid, i.e. organic compounds/additives, with the agitator so that the ratio Qc/V corresponds to:

| | |
|---|---|
| | $Qc/V \geqq 100\ h^{-1}$ |
| preferably | $Qc/V \geqq 250\ h^{-1}$ |
| and particularly preferably | $1000\ h^{-1} \geqq Qc/V \geqq 300\ h^{-1}$, |

Qc corresponding to the circulation rate of the liquid inside the tank,

- 3 circulating the liquid, homogenized by means of the agitator, in the branch loop emerging in the tank, and through at least one emulsifying system located on said loop, at a rate such that the ratio V/Qcirc corresponds to:

| | |
|---|---|
| | $0\ h < V/Qcirc \leqq 2\ h$ |
| preferably | $0\ h < V/Qcirc \leqq 1.8\ h$ |
| and particularly preferably | $0\ h < V/Qcirc \leqq 1.5\ h$, |

Qcirc corresponding to the flow rate of the liquid in the branch loop,

- 4 feeding the aqueous phase necessary for forming the emulsion into the branch loop, upstream of the emulsifying system, and finally
- 5 maintaining the homogenization in the tank and the circulation of the liquid in the branch loop until the emulsion has acquired the desired characteristics of storage stability.

This preparative process of the present invention makes it possible to prepare emulsions in industrial volumes, the ratio of water to liquid homogenized in the tank being adjusted during production to give the desired water content in the final fuel emulsion.

To obtain an emulsion of good quality which is stable over time, the steps for preparation of the homogenized liquid, i.e. organic compound(s)/additives, and for emulsification of the liquid with the water are very important, if not essential. Thus it will be possible, during the homogenization and emulsification steps, to heat and cool the liquid contained in the homogenization tank.

DETAILED DESCRIPTION OF THE INVENTION

According to a preferred mode of carrying out the invention, the process according to the invention comprises a step 1p prior to step 1, during which the additives necessary for the emulsion are mixed with at least one solvent.

The mixture of additives of step 1p is advantageously obtained by diluting the additives in at least one solvent, beginning with the most viscous additive and ending with the least viscous additive, each of these dilutions preferably being carried out in a tank equipped with at least one agitator with axial pumping displacement, for a good homogeneity, and optionally with means for heating and cooling the tank in order to improve the dilution and homogenization of said additives.

During the steps for introduction and homogenization of the additives and the organic compounds in the homogenization tank, it is essential that the additives be dispersed homogeneously throughout the volume of liquid obtained, so that, when water is added, all the additives necessary for forming and maintaining the emulsion are present in sufficient and identical amounts throughout the organic compound. It is not excluded to introduce, into either the organic phase or the aqueous phase of the emulsion formed, additives suitable for improving one or more of the required properties of the fuel according to the invention.

Within the framework of the present invention, the solvent used in step 1p is selected from the group comprising at least one of the organic compounds used to form the emulsion, a solvent of the alcohol, ketone, ester or ether type, and one of the additives of the emulsion which has adequate solvent properties towards the other additives.

The organic compound(s) according to the present invention is (are) selected from petroleum-based fuels, petrols, gas oils, kerosenes and domestic fuel oils, these products optionally being treated with oxygen-containing compounds such as TAME (tert-amyl methyl ether) or MTBE (methyl tert-butyl ether) in the case of petrols, or such as DME (dimethyl ether), DMM (dimethoxymethane) or TEP (triethoxypropane) in the case of gas oils, or refined or unrefined vegetable or animal oils or esterified derivatives thereof.

According to a preferred characteristic of the invention, the emulsifying system will comprise at least one device for circulating the liquid in the branch loop.

The aqueous phase is injected into the homogenized liquid, i.e. organic compound(s)/additives, at a rate Qe proportional to the rate Qc of circulation of the volume V of liquid in said tank, the ratio Qe/Qc varying from 0 to 1.

The ratio Qe/Qc preferably varies from 0.05 to 0.20.

This aqueous phase can also contain specific additives aimed at preventing contamination of the water, such as biocides, or antifreezes, especially in winter, for preventing the water from crystallizing and the emulsion from breaking.

The present process is particularly suitable for the preparation of emulsified fuels of water in oil, especially water-in-gas oil or water-in-petrol emulsions for combustion in internal combustion engines installed in motor vehicles, especially urban vehicles, for which it is particularly desirable to reduce the polluting exhaust emissions by taking direct action on the fuel. Likewise, it can be envisaged to use such a motor fuel for railway or marine applications or in fixed boilers or diesel engines of thermal power stations.

A second subject of the invention is the device for implementing the process, characterized in that it comprises a closed tank (1) equipped with an axial-displacement agitator (2) and comprising three fluid inlet lines (3), (4) and (5), for the organic compound(s), the additives and the emulsion respectively, a fluid outlet line (6) and optionally a heating and/or cooling system, the lines (5) and (6) being connected to a circulation line (7) defining a branch loop, which comprises a water inlet line (9) and an emulsifying system (8), and finally a discharge line (10) for the emulsified fuel. This line (10) could be placed either on the tank (1) or on the branch loop (7), upstream or downstream of the emulsifying system (8).

In the device according to the present invention, the line (4) serves to inject the mixture of additives, which has initially been prepared and homogenized in a second tank (11) equipped with an axial-displacement agitator (12) for homogenizing said mixture of additives, and comprising inlet lines (13) and an outlet line (4) for the mixture, and optionally a system for heating and/or cooling said tank (11). It is possible to use any type of heating and/or cooling insulation appropriate for a tank of industrial dimensions. The lines (3) and (4) could be merged into a single line for introducing the organic compounds and/or the additives into the tank (1).

In the tanks (1) and (11) the agitators (2) and (12) must enable the whole of the liquid contents to be homogenized and must promote the circulation of the liquid in the tank without creating a shear gradient between two points, i.e. by homogenizing at a variable defined shear rate. The chosen agitators (2) and (12) will preferably be axial-displacement agitators, which permit longitudinal agitation relative to the axis of rotation and have a high pumping capacity.

The emulsifying system (8) according to the present invention comprises at least one emulsifying pump and/or one or more dynamic mixers equipped with a rotor/stator with a narrow air gap (fixed or variable) and rotating at high speed, i.e. at more than 2000 rpm.

Downstream or upstream of this emulsifying system, or instead of it, one or more static mixers and/or one or more other emulsifying machines operating by mechanical action or by means of ultrasound and/or microwaves, cooperating in the formation of the emulsion, can be placed on the branch loop (5, 6, 7).

To promote the dispersion of water droplets in the oil, at least one droplet dispersing system, for example a cartridge or a distributor made of sintered metal or stainless steel fiber and containing very fine pores of one to several tens of microns, can be fitted to the water injection line.

BRIEF DESCRIPTION OF THE DRAWINGS

The single FIGURE attached is a simplified diagram of an example of the preferred embodiment of the device of the invention.

In the remainder of the present description, Examples are given to illustrate the problems encountered and the manufacturing constraints in the preparation of suitably emulsified and stable fuels, but they cannot be used to limit the scope of the invention.

EXAMPLE I

The present Example describes the laboratory procedure for the preparation of a water-in-gas oil emulsion by the process of the invention.

22.9 g of the mixture of additives described in patent application WO 97/34969 are poured into a 1.5-liter cylindrical beaker, followed by 673.1 g of gas oil corresponding to the European specifications of standard EN 590. 104 g of water are placed in a second beaker.

An Ultra-Turrax turbine, equipped with a T50 motor and an S50 N-G45FF rotor/stator, is placed in the first beaker and then rotated at maximum speed, i.e. 10,000 rpm, in order to homogenize the mixture in a few seconds. The water from the second beaker is then introduced very rapidly into the agitated mixture and agitation is continued for a further 5 minutes without the temperature of the resulting emulsion exceeding 50° C.

The storage stability of the emulsion thus obtained in the laboratory is more than four months at an ambient temperature of between 15 and 25° C., without the appearance of signs of demixing or sedimentation.

EXAMPLE II

The object of the present Example is to describe the optimum conditions for the industrial-scale preparation of an emulsion which is as stable as that prepared in the laboratory according to Example I.

Different emulsions were prepared in an industrial unit such as that described in the single FIGURE. Their compositions are identical to that described in Example I.

The agitator (2) is a MIXEL type MM multistep agitator equipped with three-bladed shafts.

Two emulsifying systems (8) were tested:

→ a BF 150 finishing mill, hereafter called A, sold by Pierre GUERIN TECHNOLOGIES; it is a colloid mill with rotor/stator and variable air gap;

→ a type MS dynamic homogenizer sold by Silverson, hereafter called B, with fixed air gap.

Table I lists the characteristics of fluid circulation inside the tank (1) and in the branch loop (7) returning the emulsion to the tank (1).

TABLE I

| Production | Emulsifying system | Qc/V ($h^{-1}$) (tank) | V/Qcirc (h) (branch loop) | Productivity ($m^3/h$) | Storage stability (weeks) |
|---|---|---|---|---|---|
| 1 | B | 250 | 0.5 | 7 | 18 |
| 2 | B | 0 | 0.5 | 0 | <1 |
| 3 | B | 250 | 1 | 2 | 17 |
| 4 | B | 850 | 0.25 | 10 | 24 |
| 5 | B | 50 | 0.5 | 0 | 17 |
| 6 | B | 850 | 2.2 | 0 | <1 |
| 7 | A | 340 | 1 | 4 | 21 |
| 8 | A | 250 | 1.4 | 1.5 | 20 |
| 9 | A | 0 | 1 | 0 | <1 |
| 10 | A | 110 | 1.4 | 0.5 | 20 |
| 11 | A | 50 | 1.4 | 0 | <1 |
| 12 | A | 340 | 2 | 0 | <1 |

where:

Qc is the circulation rate inside the tank and is generally given by:

$$Qc=1.5Nqp\times N\times D^3\times 60$$

Nqp being the pumping number, N the speed of rotation of the agitator shaft in the tank D the diameter of said tank, V is the volume of liquid contained in the homogenization tank (2) during the production of the emulsion, and Qcirc is the flow rate of liquid circulating outside the tank (1), downstream of the emulsifying system (8) in the branch loop on the single FIGURE.

The meaning of these symbols is given in "Techniques de l'Ingénieur", A-5900 and A-5902, in the articles by M. Roustand and J. C. Pharamond.

Table I shows that, without agitation in the tank, it is not possible to obtain a stable emulsion. Furthermore, irrespective of the emulsifying system used, what counts is that the ratio Qc/V is greater than 100 and that the emulsification or circulation time outside the tank is less than 1.5 hours in order to improve the emulsion stability and the emulsion productivity in the industrial production unit.

What is claimed is:

1. A process for industrial-scale preparation of an emulsified fuel comprising an aqueous phase in a continuous organic phase selected from the group consisting of petroleum-based fuels, petrols, gas oils, kerosenes and domestic fuel oils, which contains less than 20% by volume of water, and at least one additive necessary for forming the emulsified fuel, said process comprising the steps of:

a) preparing a liquid by introducing the at least one surfactant additive into a tank equipped with at least one agitator with axial pumping displacement and containing the organic phase, the volume of the liquid being defined as V;

b) homogenizing the volume V of liquid, with the agitator to obtain a ratio $Qc/V \geqq 100\ h^{-1}$, where Qc is the circulation rate of the liquid inside the tank;

c) circulating the homogenized liquid in a branch loop emerging from the tank, and through at least one emulsifying system located on said loop, at a rate such that:

$0\ h < V/Qcirc \leqq 2\ h$, where Qcirc is flow rate of the liquid in the branch loop;

d) feeding an aqueous phase necessary to form an emulsion into the branch loop, upstream of the emulsifying system; and e) maintaining the homogenization in the tank and the circulation of the liquid in the branch loop until the emulsion acquires a desired characteristic of storage stability.

2. The process according to claim 1, additionally comprising prior to said homogenizing, diluting the at least one additive in at least one solvent, or diluting at least two additives in decreasing order of viscosity in at least one solvent, said diluting being carried out in a tank equipped with at least one agitator, and optionally with heating and/or cooling means.

3. The process according to claim 2, wherein the solvent is at least one organic compound selected from the group consisting of an alcohol, a ketone, an ester and an ether solvent.

4. The according to claim 1, wherein the organic phase further contains at least one oxygen containing compound selected from the group consisting of tert-amyl methyl ether, methyl tert-butyl ether, dimethyl ether, dimethoxymethane, triethoxypropane and refined or unrefined vegetable or animal oils or esterified derivatives thereof.

5. The process according to claim 1, wherein the aqueous phase is injected into the homogenized liquid at a rate Qe proportional to the rate Qc of circulation of the liquid in said tank, with a ratio Qe/Qc of from 0 to 1.

6. The process according to claim 5, wherein Qe/Qc is from 0.05 to 0.20.

7. The process according to claim 1, wherein $Qc/V \geqq 250\ h^{-1}$.

8. The process according to claim 7, wherein $1000\ h^{-1} \geqq Qc/V \geqq 300\ h^{-1}$.

9. The process according to claim 1, wherein $0\ h < V/Qcirc \leqq 1.8\ h$.

10. The process according to claim 9, wherein $0\ h < V/Qcirc \leqq 1.5\ h$.

11. A device for producing an emulsified fuel comprising a water phase, an organic phase and at least one additive necessary for forming the emulsified fuel, comprising a closed tank equipped with an axial displacement agitator and comprising a fluid inlet line for organic compounds, a fluid inlet line for additives and a fluid inlet line for emulsion, a fluid outlet line for emulsion and optionally a heating and/or cooling system, the fluid inlet line for the emulsion and the fluid outlet line for the emulsion being connected to a circulation line defining a branch loop which comprises a water inlet line and an emulsifying system, and a discharge line for emulsified fuel, which is connected to the tank or the loop.

12. The device according to claim 11, additionally comprising an additive tank equipped with an axial-displacement agitator for homogenizing at least two additives, inlet lines to the additive tank for the additives, and an outlet line for additive mixture which connects to the fluid inlet line of said closed tank for additives, and optionally heating and/or cooling means.

13. The device according to claim 11, wherein the closed tank and the additive tank are each equipped with an agitator which produces longitudinal agitation relative to its axis of rotation, generating a variable defined shear rate.

14. The device according to claim 11, wherein the emulsifying system comprises at least one emulsifying pump and/or at least one dynamic mixer equipped with a rotor/stator with a fixed or variable air gap and means for rotating at a speed greater than or equal to 2000 rpm.

15. The device according to claim 11, wherein the emulsifying system comprises at least one static mixer and/or at least one other emulsifying machine operating by mechanical action or by means of ultrasound and/or microwaves.

16. The device according to claim 11, wherein the water inlet line is equipped with at least one droplet dispersing system.

* * * * *

UNITED STATES PATENT AND TRADEMARK OFFICE

CERTIFICATE OF CORRECTION

PATENT NO. : 6,589,301 B1 
DATED : July 8, 2003
INVENTOR(S) : Cesar Magnin et al.

It is certified that error appears in the above-identified patent and that said Letters Patent is hereby corrected as shown below:

Title page,
Item [30], Foreign Application Priority Data, change "Dec. 8, 1998 (FR) 98 12625" to -- Dec. 8, 1998 (FR) 98 15625 --.

Signed and Sealed this

Twenty-second Day of June, 2004

JON W. DUDAS
*Acting Director of the United States Patent and Trademark Office*